United States Patent [19]

Chu et al.

[11] 4,251,612

[45] Feb. 17, 1981

[54] DIELECTRIC OVERCOATED PHOTORESPONSIVE IMAGING MEMBER

[75] Inventors: Joseph Y. C. Chu, Fairport; Simpei Tutihasi, Webster, both of N.Y.

[73] Assignee: Xerox Corporation, Stamford, Conn.

[21] Appl. No.: 905,250

[22] Filed: May 12, 1978

[51] Int. Cl.[3] ..... G03G 5/04; G03G 5/14

[52] U.S. Cl. ..... 430/59; 430/58; 430/60; 430/63; 430/65; 430/67

[58] Field of Search ..... 96/1.5 R, 1.5 N, 1.8; 430/58, 60, 63, 65, 67, 59

[56] References Cited

U.S. PATENT DOCUMENTS

| | | | |
|---|---|---|---|
| 3,639,121 | 2/1972 | York | 96/1.5 R |
| 3,899,327 | 8/1975 | Esser et al. | 96/1.5 R |
| 4,015,985 | 4/1977 | Jones | 96/1.5 R |
| 4,123,269 | 10/1978 | Von Hoene et al. | 96/1.5 N X |
| 4,133,684 | 1/1979 | Tarumi et al. | 96/1.5 R |

*Primary Examiner*—Roland E. Martin, Jr.
*Attorney, Agent, or Firm*—J. J. Ralabate; A. A. Mahassel; E. O. Palazzo

[57] ABSTRACT

This invention relates to an electrophotographic imaging member or device and an imaging method using this imaging member, which member or device is comprised of a substrate, a layer of a charge carrier injecting material comprised of carbon or graphite dispersed in a polymer, a layer of a charge carrier transport material, a layer of a photoconductive charge carrier generating material and an electrically insulating overcoating layer. In one embodiment the imaging member is layered and comprises from the bottom up a substrate; a layer of material comprised of carbon black dispersed in a polymer, and capable of injecting holes into a layer on its surface; a hole transport layer in operative contact with the layer of hole injecting material which transport layer comprises a combination of an electrically inactive organic resin having dispersed therein an electrically active material, the combination of which is substantially nonabsorbing to visible electromagnetic radiation, but allows the injecting of photogenerated holes from a charge generator layer in contact with the hole transport layer and electrically induced holes from the layer of injecting material; a layer of charge generating material on and in operative connection with the charge transport layer and a layer of insulating organic resin overlaying the layer of charge generating material.

15 Claims, 5 Drawing Figures

DIELECTRIC OVERCOATED PHOTORESPONSIVE IMAGING MEMBER

BACKGROUND OF THE INVENTION

This invention is generally directed to an electrophotographic imaging system and more specifically to a method of imaging utilizing an improved overcoated electrophotographic imaging member.

The formation and development of images on the imaging surfaces of photoconductive materials by electrostatic means is well known, one of the most widely used processes being xerography. The art of xerography is described in C. F. Carlson U.S. Pat. No. 2,297,691 and involves the formation of an electrostatic latent image on the surface of a photosensitive plate which is usually referred to as the photoreceptor. The photoreceptor itself comprises a conductive substrate containing on its surface a layer of photoconductive insulating material; and in many instances there can be used a thin barrier layer between the substrate and the photoconductive layer to prevent charge injection from the substrate into the photoconductive layer upon changing of the plate surface since if charge injection were allowed this would adversely affect the quality of the resulting image.

The plate is charged in the dark, for example, by exposing it to an imagewise pattern of activating electromagnetic radiation. The light struck areas of the imaging layer are rendered relatively conductive and the electrostatic charge is selectively dissipated in those irradiated areas. Subsequent to exposing the photoconductor the electrostatic latent image on this image bearing surface is rendered visible with a finely-divided colored marking material known as toner. This toner is attracted principly to those areas of the image bearing surface which retain the electrostatic charge thereby forming a visible powder image. The transfer of the toner image to a receiver member such as paper with subsequent fusing of the toner into the paper provides a permanent copy. The imaging surface of the photoreceptor can then be cleaned by any of several known methods including blade cleaning, the purpose of the cleaning generally being to remove any residual toner. The electrostatic latent image can also be used in a number of other ways as, for example, electrostatic scanning systems may be employed to read the latent image or the latent image may be transferred to other materials by TESI techniques and stored. The developed image can then be read or permanently affixed to the photoconductor when the imaging layer is not to be reused.

Numerous types of photoreceptors can be used in the above described method and are well known such photoreceptors including organic materials, inorganic materials and mixtures thereof. There are known photoreceptors wherein the charge carrier generation and charge carrier transport functions are accomplished by discrete contiguous layers. Also known are photoreceptors which include an overcoating layer of an electrically insulating polymeric material and in conjunction with this overcoated type photoreceptor there have been proposed a number of imaging methods. However, the art of xerography continues to advance and more stringent demands need to be met by the copying apparatus in order to increase performance standards, to obtain higher quality images and to act as protection for the photoreceptor. In the present invention there is described an electrophotographic imaging method employing an improved overcoated electrophotographic imaging member.

U.S. Pat. No. 3,041,167 teaches an electrophotographic imaging method which employs an overcoated imaging member comprising a conductive substrate, a photoconductive insulating layer and an overcoating layer of an electrically insulating polymeric material. This member is utilized in an electrophotographic copying method by, for example, initially charging the member with an electrostatic charge of a first polarity and imagewise exposing to form an electrostatic latent image which can then be developed to form a visible image. The visible image is transferred to receiver member and the surface of the imaging member is cleaned to complete the imaging cycle. Prior to each succeeding cycle the imaging member can be charged with an electrostatic charge of a second polarity which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image is present across the photoconductive layer and the overcoating layer.

Various imaging methods can be used such as those described by Mark, in an article appearing in "Photographic Science and Engineering," Volume 18, No. 3, pages 254–261, May/June, 1974. The process referred to by Mark as the Katsuragawa and Canon processes can basically be divided into four steps. The first is to charge the insulating overcoating. This is normally accomplished by exposing it to d.c. corona of a polarity opposite to that of the majority charge carrier. When applying a positive charge to the surface of the insulating layer, as in the case where an n-type photoconductor is employed, a negative charge is induced in the conductive substrate, injected into the photoconductor and transported to and trapped at the insulating layer-photoconductive layer interface resulting in an initial potential being solely across the insulating layer. The charged plate is then exposed to a light and shadow pattern while simultaneously applying to its surface an electronic field of either alternating current (Canon) or direct current of polarity opposite that of the initial electrostatic charge (Katsuragawa). The plate is then uniformly exposed to activating radiation to produce a developable image with potential across the insulating overcoating and simultaneously reduce the potential across the photoconductive layer to zero. In other processes described in the Mark article, i.e., the Hall and Butterfield processes, the polarity of the initial voltage is the same sign as the majority charge carrier and reverse polarity is encountered during erase.

In processes where the voltage must initially be placed across the overcoating, for example, in step 1 of the Canon process, either an electron injecting contact for the majority carrier or the ability to bulk generate carriers or an ambipolar photoconducting layer must be used. In processes where the initial voltage polarity is the opposite sign of the majority carrier, there is required an injecting contact for the majority carrier, the ability to bulk generate carriers or an ambipolar photoconducting layer.

SUMMARY OF THE INVENTION

It is therefore an object of this invention to provide an imaging member and an imaging method which overcomes the above noted disadvantages.

It is another object of the invention to provide an improved overcoated photoreceptor device, and more specifically a hole injecting electrode.

Yet another object of this invention is the use in an imaging system of a dielectric overcoated photoreceptor material comprised of a p-type photoconductor.

A further specific object of the present invention is to provide a hole injeeting electrode at the interface of the photoconductor layer 16 and supporting substrate which is inexpensive, easy to prepare, is permanently attached to the conductive substrate and the hole transport layer and which does not peel off and therefore can be re-used.

These and other objects of the present invention are accomplished by providing a hole injecting electrode comprised of materials selected from the group consisting of carbon black dispersed in a polymer, and graphite-dispersed in a polymer, this layer being an interface between a substrate and the layer of charge carrier transport material. Specifically, these materials are jointed to the transport layer along a bonded interface. The particles in the hole injecting electrode are selected so as to contain sufficient available charge carriers at sufficient energy levels to form an injecting contact with the charge transport layer, the injecting layer as a whole forming a charge injecting electrode layer for the photoconductive layer. The imaging member in one embodiment is comprised of a substrate, a hole injecting layer comprised of carbon black dispersed in a polymer in contact with the substrate and a charge transport layer comprised of an electrically inactive organic resin having dispersed therein an electrically active material, the combination of which is substantially non-absorbing to visible electromagnetic radiation but allows the injection of photogenerated holes from a charge generator layer in contact with the hole transport layer and electrically induces holes from the layer of injecting material; a layer of charge generating material on and in operative connection with the charge transport layer and a layer of insulating organic resin overlaying the layer of charge generating material.

This layered structure and more specifically the hole injecting electrode can be readily formed having the desired electrical and mechanical properties by first applying the hole injecting layer to the supporting base in fluid form; evaporating the solvent or liquid carrier to solidify the hole injecting layer; followed by application of the charge carrier layer (hole transport layer) to the hole injecting layer in fluid form and evaporating off the liquid carrier of this coating. Upon final curing and cooling of the composite a strong bond is obtained between the hole injecting layer and the substrate, and the hole injecting layer and the charge carrier layer. The charge carrier layer is overcoated with a layer of photoconductor charge carrier generating material, and an electrically insulating overcoating layer.

In one preferred method of operation the member described is charged a first time with electrostatic charges of negative charge polarity, subsequently charged a second time with electrostatic charges of a positive polarity for the purposes of substantially neutralizing the charges residing on the electrically insulating surface of the member, and subsequently exposing the member to an imagewise pattern of activating electromagnetic radiation, thereby forming an electrostatic latent image. This image can then be developed to form a visible image which is transferred to a receiver member. The imaging member may be subsequently re-used to form additional reproductions after the erase and cleaning steps are accomplished.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
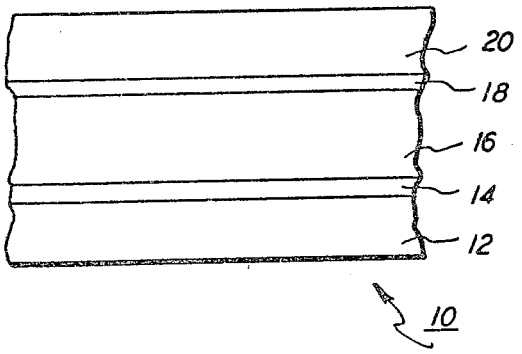
FIG. 1 is a partially schematic cross-sectional view of a photoreceptor which may be utilized in the method of the present invention.

Illustrated in FIG. 1 is a photoreceptor generally designated 10 comprising a substrate 12, a layer of charge carrier injecting material 14, a layer of charge carrier transport material 16, a layer of photoconductive charge carrier generating material 18 and a layer of electrically insulating polymeric material 20.

Substrate 12 may be opaque or substantially transparent and may comprise any suitable material having the requisite mechanical properties. The substrate may comprise a layer of non-conducting material such as an inorganic or organic polymeric material; a layer of an organic or inorganic material having a conductive surface layer arranged thereon or a conductive material such as, for example, aluminum, brass or the like. The substrate may be flexible or rigid and may have any of many different configurations such as, for example, a plate, a cylindrical drum, a scroll, an endless flexible belt, and the like. Preferably, the substrate is in the form of an endless flexible belt.

The thickness of the substrate layer depends on many factors, including economical considerations, and this layer may be of substantial thickness, for example, over 100 mils. or minimum thickness providing there are no adverse effects on the system. In one preferred embodiment this thickness ranges from about 3 mils. to about 10 mils.

Charge carrier injecting layer 14 must be capable of injecting charge carriers or holes into charge carrier transport layer 16 under the influence of an electrical field in the preferred embodiment of the invention. As will be discussed in detail herein, the injected charge carriers must be of the same polarity as the mobile carriers preferentially transported by layer 16. In one embodiment, the charge carrier injecting layer may be sufficiently laterally conductive to also serve as the ground electrode for the photoreceptor, in which case a separate additional conductive layer is not required.

Illustrative examples of materials which are capable of injecting charge carriers under the influence of an electrical field and therefore are suitable for use in layer 14 include carbon black or graphite dispersed in various polymer resins, the charge injecting electrode being prepared by solution casting of a mixture of carbon black or graphite dispersed in an adhesive polymer solution on to a support substrate such as Mylar, or aluminized Mylar. Other well known film forming techniques can be used for preparing this injecting electrode such as spraying or thermal film extrusion. The dispersed carbon black or graphite functions as a hole injecting electrode as well as a conductive medium and the polymer works as a substantially permanent adhesive between the substrate and the organic transport layer. One very important advantage associated with the use of a carbon black or graphite dispersion as a charge injecting electrode is that it adheres substantially permanently to the support substrate as well as to the transport layer which is not the situation when using materials, for example, such as gold and aluminum. Thus, the injecting layer does not have a tendency to peel off, that is, to be separated from the transport and the support layer so that the quality of the image is not adversely affected after repetitive usage. Additionally, of course, although it is possible to redeposit the gold and aluminum and prepare a further photoreceptor after sufficient peeling has been noticed so as to cause adverse affects in the entire system and perhaps reach a point of non-usability, this is not only time consuming but is very uneconomical. In any event, carbon black and graphite are rather inexpensive materials when compared to gold and aluminum, and more readily available and function more effectively than gold or aluminum.

Illustrative examples of polymers that can be used as the material within which the carbon black or graphite is dispersed include, for example, polyesters such as PE-100 commercially available from Goodyear Chemical Company. Other polyester materials that are useful include those materials classified as polymeric esterification products of a dicarboxylic acid and a diol comprising a diphenol. Typical diphenols include 2,2-bis(4-beta hydroxy ethoxy phenyl)-propane, 2,2-bis (4-hydroxy isopropoxy phenyl)propane, 2,2-bis(4-beta hydroxy ethoxy phenyl)pentane, 2,2-bis(4-beta hydroxy ethoxy phenyl) butane and the like, while typical dicarboxylic acids include oxalic acid, malonic acid, succinic acid, adipic acid, phthalic acid, terephthalic acid, maleic acid, fumaric acid and the like. Any polyester or other polymeric materials may be used providing they do not adversely affect the system and allow a uniform dispersion of the carbon black or graphite therein.

Numerous forms of carbon black and graphite are useful including furnace carbon blacks and channel carbon blacks commercially available from many sources such as Cabot Corporation. Illustrative examples of these materials include carbon blacks such as Vulcan XC-72R, Vulcan 6, Black Pearls L and Monarch 1300 all commercially available from Cabot Corporation, and graphite commercially available from Superior Graphite Co. Other carbon blacks are useful providing they do not substantially adversely affect the imaging method; however, such materials should have sufficient conductivity, be capable of injecting holes which is most important, and be capable of being uniformly dispersed in a polymer material. Insofar as conductivity is concerned, these materials used can have a range of electrically resistivity values which depend on many factors, such as the thickness of the hole injecting electrode. Generally, the range of electrical resistivity is less than 20,000 ohms per square when the thickness of the hole injecting electrode is from about 4 to about 7 microns. The electrical resistivity can be greater than 20,000 or substantially less providing that the properties of the imaging member are not adversely affected.

The ratio of polymer to carbon black or graphite ranges from about 0.5 to 1 to 2 to 1, with a preferred range of about 6 to 5. Other ranges can, of course, be suitable providing a uniform dispersion of carbon black or graphite is obtained in the polymer.

The hole injecting layer has a thickness in the range of from about 1 to about 20 microns or more with the preferred range being from about 4 microns to about 10 microns. The maximum thickness is generally determined by the mechanical properties desired. The charge carrier injecting materials and charge carrier transport materials require a particular work function relationship in order that the holes or electrons to be injected from the former into the latter can be effectively accomplished. Normally the hole injecting materials have a relatively high work function whereas electron injecting materials have a relatively low work function.

The charge carrier transport layer 16 can be any number of numerous suitable materials which are capable of transporting holes, this layer generally having a thickness in the range of from about 5 to about 50 microns and preferably from about 20 to about 40 microns. In a preferred embodiment this transport layer comprises molecules in the formula:

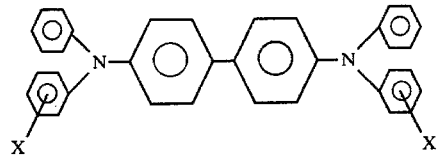

dispersed in a highly insulating and transparent organic resinous material wherein X is selected from the group consisting of (ortho) $CH_3$, (meta) $CH_3$, (para) $CH_3$, (ortho) Cl, (meta) Cl, (para) Cl. This charge transport layer, which is described in detail in copending application Ser. No. 716,403 (series of 1970) filed by Milan Stolka, et al., on Aug. 23, 1976, and totally incorporated herein by reference, is substantially non-absorbing in the spectral region of intended use, i.e., visible light, but is "active" in that it allows injection of photogenerated holes from the charge generator layer and electrically induced holes from the injecting interface. The highly insulating resin, which has a resistivity of at least $10^{12}$ ohm-cm to prevent undue dark decay, is a material which is not necessarily capable of supporting the injection of holes from the injecting or generator layer and is not capable of allowing the transport of these holes through the material. However, the resin becomes electrically active when it contains from about 10 to 75 weight percent of the substituted N,N,N',N'-tetraphenyl[1,1'-biphenyl]4-4'-diamines corresponding to the foregoing formula. Compounds corresponding to this formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl and 4-methyl, ethyl, propyl, butyl, hexyl and the like. In the case of chloro substitution, the compound is named N,N'-diphenyl-N,N'-bis (halo phenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes include triphenylmethane, bis(4-diethylamino-2-methylphenyl) phenylmethane; 4',4''-bis (diethylamino)-2'2''-dimethyltriphenyl methane; bis-4 (-diethylamino phenyl) phenylmethane; and 4,4'-bis (diethylamino)-2,2'-dimethyltriphenylmethane.

Transport layer 16 may comprise any transparent electrically inactive binder resinous material such as those described by Middleton, et al., in U.S. Pat. No. 3,121,006, incorporated herein by reference. The resinous binder contains from 10 to 75 weight percent of the active material corresponding to the foregoing formula and preferably from about 40 to about 50 weight percent of this material. Typical organic resinous materials useful as the binder include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight ($M_w$) of from about 20,000 to about 100,000 with a molecular weight in the range of from about 50,000 to about 100,000 being particularly preferred.

Photoconductive charge carrier generating layer 18 generally may comprise any photoconductive charge carrier generating material known for use in electrophotography provided it is electronically compatible with charge carrier transport layer 16, that is, it can inject photoexcited charge carriers into the transport layer and charge carriers can travel in both directions across the interface between the two layers. Particularly preferred photoconductive charge carrier generating materials include amorphous and trigonal selenium, selenium-arsenic and selenium-tellurium alloys and organic charge carrier generating materials such as phthalocyanines like metal free, for example, the X-form of phthalocyanine, or metal phthalocyanines including vanadyl phthalocyanine. These materials can be used alone or as a dispersion in a polymeric binder. Layer 18 is typically from about 0.5 to about 10 microns or more in thickness. Generally, it is desired to provide this layer in a thickness which is sufficient to absorb at least 90 percent (or more) of the incident radiation which is directed upon it in the imagewise exposure step. The maximum thickness is dependent primarily on factors such as mechanical considerations, e.g., whether a flexible photoreceptor is desired.

Electrically insulating overcoating layer 20 typically has a bulk resistivity of from about $10^{12}$ to about $5\times10^{14}$ ohm-cm and typically is from about 5 to about 25 microns in thickness. Generally, this layer provides a protective function in that the charge carrier generating layer is kept from being contacted by toner and ozone which is generated during the imaging cycles. The overcoating layer also must prevent charges from penetrating through it into charge carrier generating layer 18 or from being injected into it by the latter. Preferably, therefore, layer 20 comprises materials having higher bulk resistivities. Generally, the minimum thickness of the layer in any instance is determined by the functions the layer must provide whereas the maximum thickness is determined by mechanical considerations and the resolution capability desired for the photoreceptor. Typical suitable materials include Mylar (a polyethylene terephthalate film available from E. I. duPont de Nemours), polyethylenes, polycarbonates, polystyrenes, polyesters, polyurethanes and the like. The particular material selected in any instance should not be one which will dissolve or react with the materials used in layers 16 and 18.

The formation of the electrically insulating layer 20 over the previous layer may be carried out by solution coating. Where layer 20 constitutes a preformed mechanically tough film, it is typically necessary to provide sufficient adhesive material in order to provide an integral structure which is desirable for use in a repetitive imaging method. The electrical properties of any such adhesive interlayer should be similar to those of the overcoating. Alternatively, they may be similar to the binder material of the charge carrier generating layer 18 where a binder material is present in that layer. Mechanically, the adhesive interlayer should provide an adhesive state that firmly binds the layers together without any air gaps or the like which could disturb image definition.

Figure 2A:
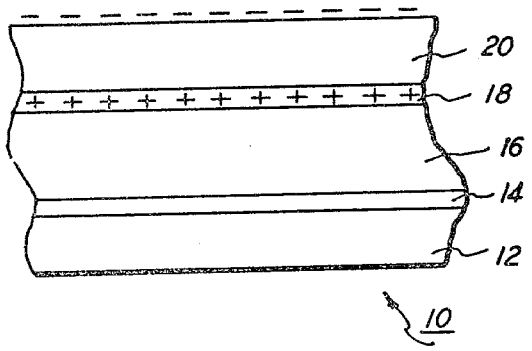
FIGS. 2*a* to 2*c* illustrate the various method steps employed.
Figure 2B:
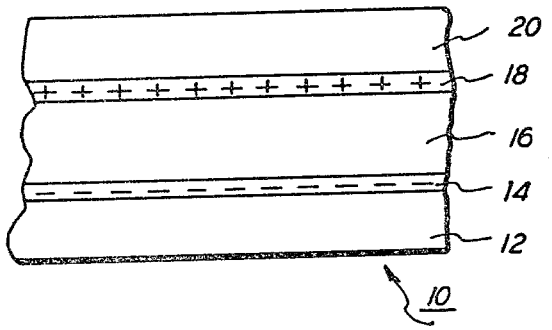
Figure 2C:
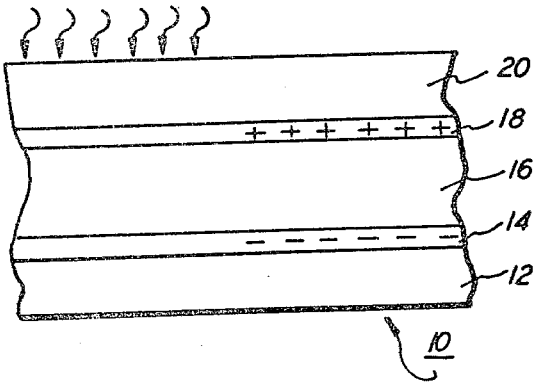

The operation of the member is illustrated with respect to FIGS. 2A–2C. In this illustrative explanation the charge carrier injecting material and the initial charging step is carried out with negative polarity. As noted previously, the method is not limited to this embodiment. Moreover, the description of the method will be given in conjunction with the proposed theoretical mechanism by which the method is thought to be operative in order to better aid those skilled in the art to understand and practice the invention. It should be noted, however, that the method has been proved to be operable and highly effective through actual experimentation and any inaccuracy in the proposed theoretical mechanism of operation is not to be construed as being limiting of the invention.

Referring now to FIG. 2A, there is seen the condition of the photoreceptor after it has been electrically charged negatively a first time in the absence of illumination by any suitable electrostatic charging apparatus such as a corotron. The negative charges reside on the surface of electrically insulating layer 20. As a consequence of the charging an electrical field is established across the photoreceptor and as a consequence of the electrical field holes are injected from the charge carrier injecting layer into the charge carrier transport layer. The holes injected into the charge carrier transport layer are transported through the layer, enter into the charge carrier generating layer 18, and travel through the latter until they reach the interface between the charge carrier generating layer 18 and the electrically insulating layer where they become trapped. The charges thus trapped at the interface establish an electrical field across the electrically insulating layer 20. Thus, it is seen that in the embodiment where negative charging is carried out in the first charging step charge carrier injecting layer 14 and charge carrier transport layer 16 must comprise materials which will allow injection of holes from the former into the latter and charge transport layer 16 preferably comprises material which will predominantly transport holes. Also, it can be seen that the charge carrier transport layer 16 and the charge carrier generating layer 18 must comprise materials which will allow injection of holes from the former into the latter and allow the holes to reach the interface between layer 18 and electrically insulating layer 20. Generally, the charging step is carried out with a voltage in the range of from about 10 volts/micron to about 100 volts/micron.

Subsequently, the member is charged a second time, again in the absence of illumination, with a polarity opposite to that used in the first charging step in order to substantially neutralize the charges residing on the surface of the member. In this illustrative instance, the second charging of the member is with positive polarity. After the second charging step the surface of the photoreceptor should be substantially free of electrical charges. The substantially neutralized surface is created by selecting a charging voltage based on the dielectric thickness ratio of the overcoating layer 20 to the total of the charge carrier transport and charge carrier generating layers, 16 and 18 respectively. By "substantially neutralized" within the context of this invention is meant that the voltage across the photoreceptor member, upon illumination of the photoreceptor, may be brought to substantially zero.

FIG. 2B illustrates the condition of the photoreceptor after the second charging step. In this illustration no charges are shown on the surface of the member. The positive charges residing at the interface of layers 18 and 20 as a result of the first charging step remain trapped at that interface at the end of the second charging step. However, there is now a uniform layer of negative charges located at the interface between layers 14 and 16.

Therefore it can be seen that the net result of the second charging step is to establish a uniform electrical field across the charge carrier transport and charge carrier generating layers. To achieve this result it is critical that the negative charges be located at the interface between charge carrier injecting layer 14 and charge carrier transport layer 16 and prevented from entering into the transport layer. For this reason it is preferred to utilize a charge carrier transport material which will transport only one species of charge carrier, holes in this illustrative instance. Where a charge carrier transport material capable of transporting both species of charge carriers is employed in layer 16 it is apparent that the charge carrier injecting material would have to be selected so that the latter would be unable to inject electrons in layer 16 thus placing constraints on the selection of materials.

Subsequently, the member is exposed to an imagewise pattern of electromagnetic radiation to which the charge carrier generating material comprising layer 18 is responsive. The exposure of the member may be effected through the electrically insulating overcoating. As a result of the imagewise exposure an electrostatic latent image is formed in the photoreceptor. This is because hole-electron pairs are generated in the light-struck areas of the charge carrier generating layer. The light-generated holes are injected into the charge carrier transport layer and travel through it to be neutralized by the negative charges located at the interface between layers 14 and 16 wherein the light-generated electrons neutralize the positive charges trapped at the interface between layers 18 and 20. In the areas of the member which did not receive any illumination, the positive charges remain in their original position. Thus, there continues to be an electrical field across the charge carrier transport and charge carrier generating layers in areas which do not receive any illumination whereas the electrical field across the same layers in the areas which receive illumination is discharged to some low level.

In a preferred embodiment of the present invention, reference FIG. 1, the support substrate 12 is Mylar, the hole injecting electrode 14 is carbon black dispersed in a polymer, the transport layer 16 is a N,N'-diphenyl-N,N' bis (3-methylphenyl)-[1,1'-biphenyl]4-4' diamine, dispersed in a polymer matrix, the generator layer 18 contains $As_2Se_3$, amorphous selenium, trigonal selenium, Se-Te alloys, metal or metal free phthalocyanines dispersed in a polymer matrix and the insulating layer 20 is polyurethane.

Figure 3:
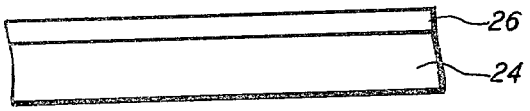
FIG. 3 illustrates an important embodiment of the present invention.

In FIG. 3 there is illustrated another important embodiment of the present invention comprised of a substrate 24, equivalent to layer 12, such as Mylar and a hole injecting electrode 26 comprised of carbon black dispersed in a polymer.

The electrostatic latent image formed in the member may be developed to form a visible image by any of the well known xerographic development techniques, for example, cascade, magnetic brush, liquid development and the like. The visible image is typically transferred to a receiver member by any conventional transfer technique and affixed thereto. While it is preferable to develop the electrostatic latent image with marking material the image may be used in a host of other ways such as, for example, "reading" the latent image with an electrostatic scanning system.

When the photoreceptor is to be reused to make additional reproductions as is the case in a recyclible xerographic apparatus any residual charge remaining on the photoreceptor after the visible image has been transferred to a receiver member typically is removed therefrom prior to each repetition of the cycle as is any residual toner material remaining after the transfer step. Generally, the residual charge can be removed from the photoreceptor by ionizing the air above the electrically insulating overcoating of the photoreceptor while the photoconductive carrier generating layer is uniformly illuminated and grounded. For example, charge removal can be effected by A.C. corona discharge in the presence of illumination from a light source or preferably a grounded conductive brush could be brought into contact with the surface of the photoreceptor in the presence of such illumination. This latter mode also will remove any residual toner particles remaining on the surface of the photoreceptor.

The invention will now be described in detail with respect to specific preferred embodiments thereof, it being understood that these Examples are intended to be illustrative only and the invention is not intended to be limited to the materials, conditions, process parameters, etc., recited herein. All parts and percentages are by weight unless otherwise indicated.

EXAMPLE I

A photoreceptor was fabricated by coating a mixture of 6 percent PE-100, a polyester commercially available from Goodyear Chemicals and 5 percent carbon black-Monarch 1300 commercially available from Cabot Corporation (in chloroform and ball milled for 17 hours) on a plain Mylar substrate having a thickness of approximately 125 microns using a Gardner mechanical drive film coating apparatus equipped with a 1.5 mil gap film applicator. The uniformly coated film was dried in a vacuum oven at about 60° C. for 2–3 hours. The dried film was then overcoated with a hole transport layer comprised of a 1:1 ratio of N,N'-diphenyl-N,N' bis (3-methylphenyl)-[1,1'-biphenyl]-4,4'-diamine and Makrolon polycarbonate commercially available from Mobay Chemical Company and the entire structure was dried in a vacuum oven at approximately 0.6 micron thick amorphous arsenic triselenide layer was vacuum deposited over the transport layer and an approximately ½ mil thick Mylar overcoating layer was then laminated over the arsenic triselenide layer.

The photoreceptor was charged a first time with a potential of −500 volts and then charged a second time with a potential of +1000 volts, the photoreceptor was then uniformly illuminated with white light. Electrical measurements show that the field across the photoreceptor was discharged to substantially zero potential thus indicating that the photoreceptor is suitable for use according to the method of the present invention.

For comparison purposes, other hole injecting electrodes were made in accordance with the method described above with the exception that no generator or insulating layer were used and the following results were noted: the better injecting electrodes are represented by the lower negative values.

| HOLE INJECTING ELECTRODE | SUB-STRATE | SURFACE POTENTIAL, VOLTS POSITIVE | NEG-ATIVE | ADHESION |
|---|---|---|---|---|
| Gold | Al-Mylar | 400 | 0–2 | Poor |
| Graphite layer on Polybrene | Al | 400 | 40 | Very Poor |
| Graphite/ PE-100 (1:1) | Mylar | 450 | 0–2 | Excellent |
| Carbon black/ PE-100 (6:5) | Mylar | 550 | 0–2 | Excellent |

EXAMPLE II

A photoreceptor was fabricated by coating carbon black dispersed in a polymer film which was prepared by coating a mixture of 6 percent PE-100 polyester commercially available from Goodyear and 5 percent carbon black Monarch 1300 commercially available from Cabot Corporation, (in chloroform ball milled for 17 hours) on Mylar using a Gardner mechanical drive film coating apparatus equipped with a 1.5 mill gap film applicator. In an approximately 25 micron thick layer of N,N′-diphenyl-N,N′-bis (3-methylphenyl)-[1,1′-biphenyl]-4-4′ diamine in a polycarbonate binder (1:1 ratio) was formed on the carbon black layer by solvent coating from a methylene chloride solution using a draw bar coating technique. The member was then dried in a vacuum oven at a temperature of about 70° C. for about 24 hours. An approximately 0.6 micron thick amorphous arsenic triselenide layer was vacuum deposited over the transport layer and an approximately ½ mil thick acrylic resin overcoating layer (Futura Floor Wax available from Johnson & Johnson) was then placed over the arsenic triselenide layer and air dried for 24 hours.

The photoreceptor was charged at a first time with a potential of −500 volts and then charged a second time with a potential of +1000 volts. The photoreceptor was then uniformly illuminated with white light. Electrical measurements show that the field across the photoreceptor was discharged to substantially zero potential thus indicating that the photoreceptor is suitable for use according to the method of the present invention.

EXAMPLE III

A photoreceptor similar to that described in Example II was prepared with the exception that the charge carrier generating layer was selenium instead of arsenic triselenide, the charge carrier transport layer was about 20 microns thick and the carbon black used was Vulcan 6 commercially available from Cabot Corporation. The photoreceptor was charged a first time with a potential of −1300 volts, a second time with a potential of +1800 volts and then uniformly illuminated with white light. Electrical measurements show that the photoreceptor was discharged to substantially zero potential thus indicating the photoreceptor is suitable for use according to the method of this invention.

EXAMPLE IV

A photoreceptor similar to that described in Example II was prepared with the exception that the carbon black used was Black Pearls L commercially available from the Cabot Corporation and substantially similar results were obtained when the photoreceptor was charged at different potentials.

EXAMPLE V

A photoreceptor similar to that described in Example II was prepared with the exception that instead of carbon black dispersed in a polymer there was used instead graphite commercially available from Superior Graphite Company, which graphite was dispersed in the same polymer and substantially the same results were obtained when the photoreceptor was charged at a first negative potential and then at a second positive potential.

EXAMPLE VI

A 4 inch by 4 inch sample of the photoreceptor as prepared in Example III was used to produce a xerographic reproduction with a Zerox Model D processor and a good quality reproduction was obtained.

EXAMPLE VII

A photoreceptor was fabricated using approximately a 5 mil thick Mylar substrate. A charge injecting composition was formed by preparing a 12 percent solution of PE-100 polyester resin available from Goodyear Chemicals in chloroform, adding to it approximately about 10 percent by weight of carbon black and ball milling the mixture for about 24 hours with steel shot. An approximately 4–6 micron thick layer of the composition was deposited on the Mylar substrate and the sample was then dried to remove residual solvents. An approximatey 25 micron thick charge carrier transport layer made up of the composition as used in Example II was deposited over the charge carrier injecting layer by solvent coating from a methylene chloride solution. The sample was dried to remove residual solvent by placing it in a vacuum oven at a temperature of about 70° C. for about 24 hours. An approximately 0.5 micron thick layer of amorphous selenium was vacuum deposited over the transport layer and finally an approximately 0.5 mil thick layer of Mylar having a polyester adhesive preapplied thereto was laminated to the selenium layer with the polyester adhesive in contact with the selenium layer employing a Model 275 LM laminator commercially available from General Binding Corporation, Norfolk, Illinois. The charge carrier injecting layer had sufficient lateral conductivity to also serve as the ground electrode for the photoreceptor. Testing of the photoreceptor according to the method of this invention showed that it was suitable for use in such a method.

EXAMPLE VIII

A photoreceptor was fabricated by coating an approximately 6 mil thick aluminized Mylar substrate with an approximately 6 micron layer of the charge carrier injecting composition as described in Example VII by the same technique described. An approximately 28 micron thick charge carrier transport layer of the same composition as used in the previous example was deposited over the charge carrier injecting layer by solvent coating from a methylene chloride solution. The sample was then dried in a vacuum oven at a temperature of about 70° C. for about 24 hours.

A charge carrier generating composition was prepared by placing 0.7 grams of alpha metal free phthalocyanine and 1.5 grams of 49,000 polyester resin commercially available from E. I. duPont and methylene chloride and ball milling for about 78 hours. An approximately 3 micron thick layer of this composition was deposited over the transport by solvent coating using a draw bar coating technique. This sample was dried to remove residual solvent. Finally, an approximately 10 micron thick layer of PE-100 polyester resin as described hereinbefore was deposited over the charge carrier generating layer by solvent coating from methylene chloride solution using a draw bar coating technique. The sample was again dried to remove residual solvent.

The photoreceptor was charged a first time with a potential of −1200 volts, charged a second time with a potential of +2400 volts and subsequently illuminated with white light. Electrical measurements showed that the field across the photoreceptor was discharged to substantially zero, thus indicating that the photoreceptor is suitable for use according to the method of the present invention.

A reproduction was made with a Xerox Model D processor employing the photoreceptor described above. A good quality reproduction was obtained.

EXAMPLE IX

The procedure of Example VIII is repeated with the exception that in place of the alpha metal free phthalocyanine there was used (1) trigonal selenium, (2) vanadyl phthalocyanine and substantially similar results were obtained.

Although the invention has been described with respect to specific preferred embodiments, it is not intended to be limited thereto, but rather those skilled in the art will recognize that variations and modifications may be made therein which are within the spirit of the invention and the scope of the claims.

What is claimed is:

1. A layered photosensitive imaging member which comprises from the bottom up:

(a) an electrically conductive substrate;

(b) a layer of material capable of injecting holes into a layer on its surface, this layer being comprised of materials selected from the group consisting of carbon dispersed in a polymer and graphite dispersed in a polymer;

(c) a hole transport layer in operative contact with the layer of hole injecting material, which transport layer comprises a combination of a highly insulating organic resin having dispersed therein small molecules of an electrically active material, the combination of which is substantially non-absorbing to visible light but allows injection of photogenerated holes from a charge generator in contact with the hole transport layer and electrically induced holes from the layer of injecting material;

(d) a layer of charge generating photoconductive material on and in operative contact with the charge transport layer; and (e) a layer of insulating organic resin overlaying the layer of charge generating material.

2. An imaging member in accordance with claim 1 wherein the hole injecting material is carbon black dispersed in a polyester.

3. An imaging member in accordance with claim 1 wherein the hole injecting material is graphite dispersed in a polyester.

4. An imaging member in accordance with claim 1 wherein the substrate is a polyethylene terphthalate film.

5. An imaging member in accordance with claim 1 wherein the ratio of polymer to carbon black or graphite ranges from about 0.5:1 to 2:1.

6. An imaging member in accordance with claim 1 wherein the hole injecting electrode has a thickness in the range of from about 1 to about 20 microns.

7. An imaging member in accordance with claim 1 wherein the hole injecting electrode has a thickness in the range of from about 4 to about 10 microns.

8. An imaging member in accordance with claim 1 wherein the electrically active material dispersed in the insulating organic resin is a nitrogen containing compound of the formula:

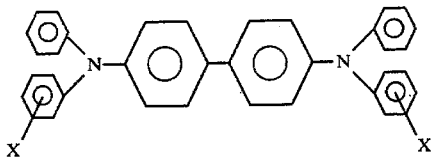

wherein X is selected from the group consisting of (ortho) $CH_3$, (meta) $CH_3$, (para) $CH_3$, (ortho) Cl, (meta) Cl, (para) Cl.

9. An imaging member in accordance with claim 8 wherein the hole transport layer contains from about 10 to 75% of the nitrogen containing composition.

10. An imaging member in accordance with claim 1 wherein the transport layer is N,N'-diphenyl-N,N'-bis(3-methyl phenyl)-[1,1'-biphenyl]-4,4'-diamine.

11. An imaging member in accordance with claim 1 wherein the charge generating photoconductive layer is selected from the group consisting of amorphous selenium, trigonal selenium, arsenic triselenide, metal free phthalocyanines and metal phthalocyanines.

12. An imaging member in accordance with claim 11 wherein the charge generating photoconductive layer is amorphous selenium.

13. An imaging member in accordance with claim 11 wherein the charge generating photoconductive layer is trigonal selenium.

14. An imaging member in accordance with claim 11 wherein the phthalocyanine is vanadyl phthalocyanine.

15. An imaging member in accordance with claim 1 wherein layer (e) is a polyurethane resin.

* * * * *